US005224525A

United States Patent [19]

Weichel

[11] Patent Number: 5,224,525

[45] Date of Patent: Jul. 6, 1993

[54] HOSE NOZZLE

[75] Inventor: Rainer Weichel, Hamburg, Fed. Rep. of Germany

[73] Assignee: Oscar Gossler KG (GmbH & Co.), Reinbek, United Kingdom

[21] Appl. No.: 736,249

[22] Filed: Jul. 26, 1991

[30] Foreign Application Priority Data

Jul. 26, 1990 [DE] Fed. Rep. of Germany ... 9011041[U]

[51] Int. Cl.[5] ..... B65B 3/36; B65B 57/14

[52] U.S. Cl. ..... 141/207; 141/206; 141/208; 141/226; 141/DIG. 1; 251/65

[58] Field of Search ..... 141/206, 207, 208, 209, 141/210, 211, 214, 215, 217, 218, 225, 226, 227, 228, 392, DIG. 1; 137/901; 251/64, 65; 22/64, 65

[56] References Cited

U.S. PATENT DOCUMENTS

| | | | |
|---|---|---|---|
| 2,702,659 | 2/1955 | Henry | 141/215 |
| 3,817,285 | 6/1974 | Wilder et al. | 141/206 |
| 4,418,730 | 12/1983 | McMath | 141/208 |
| 4,497,350 | 2/1985 | Guertin | 141/206 |

*Primary Examiner*—Henry J. Recla
*Assistant Examiner*—Steven O. Douglas
*Attorney, Agent, or Firm*—Robert W. Becker & Associates

[57] ABSTRACT

A hose nozzle for filling fluid into a tank and for shutting off automatically when the tank is filled is provided. The hose nozzle comprises a housing that has an inlet nozzle and an outlet pipe at opposite ends of the housing and a grip portion of an area of the inlet nozzle. A flow valve is disposed in the housing between the inlet nozzle and the outlet pipe whereby the flow valve further comprises a valve rod. A control device is provided that comprises a pressure channel and a plunger-type control element, for closing the flow valve depending on a pressure present in the pressure channel, against a direction of fluid flow, whereby the control device is disposed in the housing between the inlet nozzle and the flow valve and whereby the pressure channel is connected to a port of the outlet pipe. A manual lever, disposed within the grip portion and connected with one end thereof to the control device, actuates the flow valve and controls a fluid flow from the inlet nozzle to the outlet pipe. A control lever that is pivotably connected with a first end thereof to the one end of the manual lever and with a second end thereof to the valve rod actuates the valve rod.

5 Claims, 9 Drawing Sheets

HOSE NOZZLE

The present invention relates to a hose nozzle for filling fluids into containers such as fuel tanks of vehicles and for automatically shutting off when the tank is filled.

EP-OS 0 239 193 describes a hose nozzle having a housing, provided with an inlet nozzle and an outlet pipe and a manual lever disposed at the housing for actuating a flow valve for controlling the fluid flow from the inlet nozzle to the outlet pipe and furthermore having a control device that is connected via a pressure channel to the port of the outlet pipe and depending on the pressure present within the pressure channel, closes the flow valve. The control device, having a plunger-type control element, when viewed in the flow direction of the fluid, is arranged behind the flow valve that controls the fluid flow. In the area between the housing and the outlet pipe a spring-loaded check valve is also provided. This check valve which is required to maintain fluid in all of the chambers through which fluid is guided except the outlet pipe, not only increases the weight but a so the dimensions and the manufacturing costs of such a hose nozzle.

It is therefore an object of the present invention to provide a hose nozzle which may be manufactured at low cost and which is light-weight and small.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
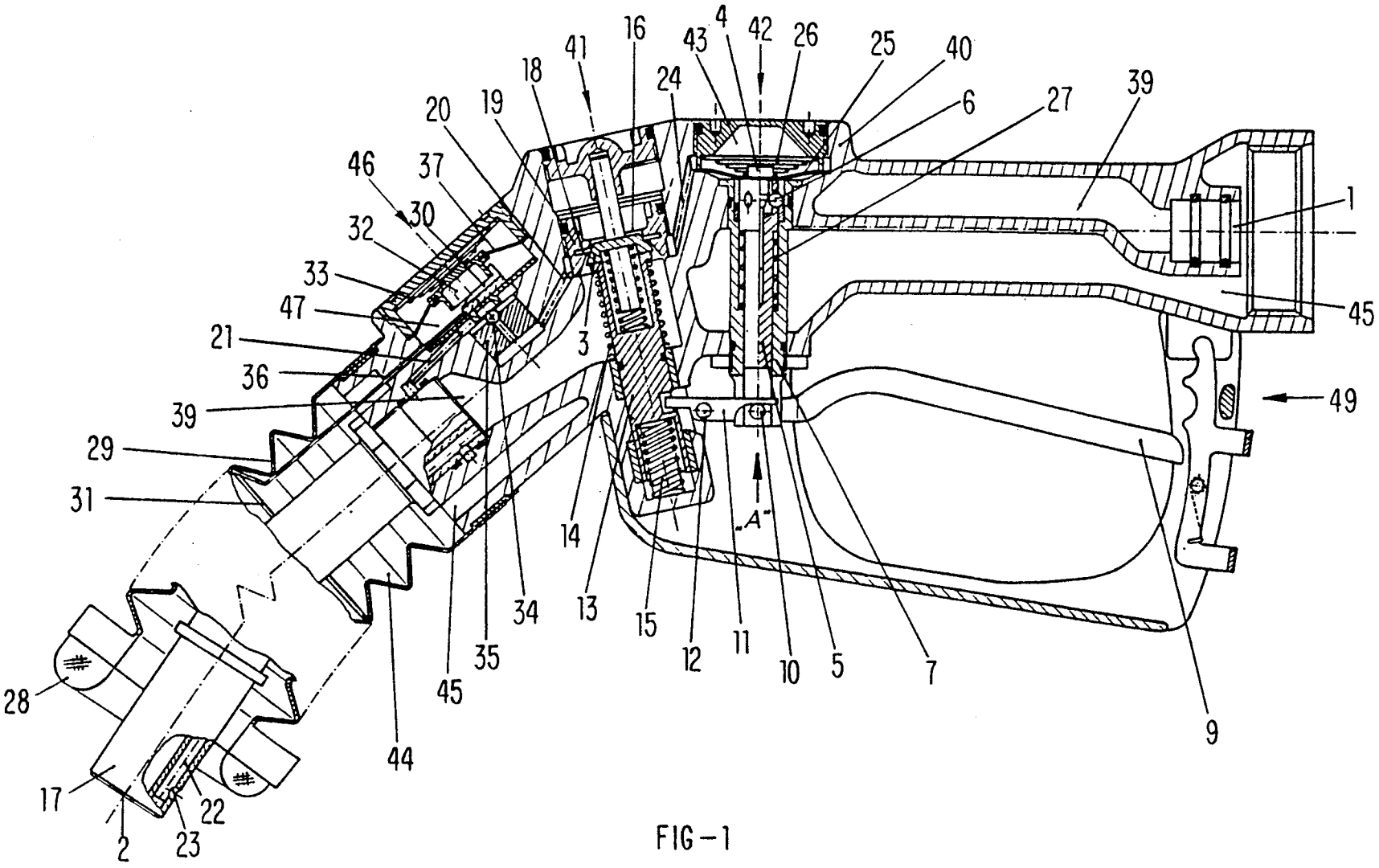
FIG. 1 is a cross-sectional view of the inventive hose nozzle.

The hose nozzle of the present invention is primarily characterized by a housing that further comprises an inlet nozzle and an outlet pipe at opposite ends of the housing and a grip portion in an area of the inlet nozzle;

a flow valve disposed in the housing between the inlet nozzle and the outlet pipe, whereby the flow valve further comprises a valve rod; a control means, comprising a pressure channel and a plunger-type control element, for closing the flow valve depending on a pressure present in the pressure channel, against a direction of fluid flow, whereby the control means is disposed in the housing between the inlet nozzle and the flow valve and whereby the pressure channel is connected to a port of the outlet pipe; a manual lever, disposed within the grip portion and connected with one end thereof to the control means, for actuating the flow valve and controlling the fluid flow from the inlet nozzle to the outlet pipes; and a control lever that is pivotably connected with a first end thereof to the one end of the manual lever and with a second end thereof to the valve rod.

In a further embodiment the hose nozzle comprises also a bellows surrounding the outlet pipe and connected with one end to the housing in a gas-tight manner and with the other end arranged adjacent to the port of the outlet pipe; a sealing element connected to the other end of the bellows adapted to engage a filling nozzle of a tank to be filled; an annular channel disposed between the outlet pipe and the bellows: a gas recycling channel that is connected to the inlet nozzle and the annular channel; a connecting channel connecting the control means and the pressure channel; and a safety means for closing the connecting channel.

In a preferred embodiment, the safety means comprises a slide bar that is operatively connected to the bellows; a membrane disposed in a recess of the housing; a permanent magnet connected to the membrane, with a position of the permanent magnet being changed by displacement of the slide bar; and a ball valve that is positioned in the connected channel and is actuated by the permanent magnet, for closing the connecting channel.

Preferably, a push rod is connected to the bellows and engages the slide bar. Furthermore, the membrane in the recess delimits a pressure chamber that communicates with the annular channel.

Due to the arrangement and embodiment of the flow valve, which according to the present invention is provided behind the control means when viewed in the direction of flow of the fluid to be dispensed, and closes against the flow of said fluid, a check valve which prevents leakage of the fluid when the flow valve is closed, arranged between the housing and the outlet pipe, is no longer required. Due to this inventive measure the hose nozzle may be manufactured at lower cost and with smaller dimensions. Furthermore, due to the small fluid volume within the hose nozzle the weight of the hose nozzle is reduced which in turn facilitates the handling of the hose nozzle during the filling of fuel tanks of vehicles. The inventive closing direction of the flow valve against the flow of the fluid furthermore prevents pressure surges within the inlet system of the hose nozzle, especially during the automatic shut-off step. The actuation of the flow valve with one end of the two-legged manual lever via a control lever that is pivotably connected to the two-legged end of that manual lever, whereby one end of the control lever is connected to the valve rod of the flow valve and the other end of the control lever is connected at the pivoting point of the manual lever, furthermore has the advantage that by selecting the pivoting point of the control lever at the manual lever as well as the pivoting point of the manual lever at the housing the forces transmitted onto the control means may be reduced so that the dimensions of this control means may also be reduced. By suitably selecting these pivoting points and the transmission ratio at the control lever the shut-off properties of the hose nozzle may be simply adjusted to the composition of the fluid to be dispensed (gasoline, diesel fuel).

In order to recycle gases that are displaced during the filling process of a container, in a preferred embodiment of the inventive hose nozzle the outlet pipe is surrounded by a bellows one end of which is connected in a gas-tight manner to the housing and the other end of which, in the area of the port of the outlet pipe is provided with a sealing element that is adapted to cooperative with the filling nozzle of the container to be drilled. The annular channel between the outlet pipe and the bellows is connected to a gas recycling channel provided at the inlet nozzle. For interrupting and/or preventing fluid dispersion of the hose nozzle when the outlet pipe is not properly inserted into the filling nozzle of the container to be filled, i.e., no gas-tight seal between the filling nozzle and the bellows is achieved, in the preferred embodiment of the invention the bellows is operatively connected via a push rod to a slide bar which chances the position of a permanent magnet within the housing. The permanent magnet cooperates with a ball valve for interrupting the connecting channels between the control means and the pressure channel in the outlet pipe for actuating the control means. The permanent magnet may be disposed on a membrane which allows changing of its position within the housing. The membrane further delimits a pressure chamber that communicates with the annular channel between the bellows and the outlet pipe. When excessive pressure occurs within the gas recycling system the pressure chamber has the function to control the ball valve such that the control means prevents the dispension of fluid.

DESCRIPTION OF PREFERRED EMBODIMENTS

The present invention will now be described in detail with the aid of several specific embodiments utilizing FIGS. 1 through 5.

The hose nozzle represented in FIG. 1 comprises a housing 40 with a grip portion 49. The housing 40 has an inlet nozzle 1 through which the fluid to be dispensed flows via a fluid channel 39 to the port 2 of an outlet pipe 17 disposed at the housing 40. The fluid flow may be interrupted respectively controlled by valve body 3 of a flow valve 41. The valve body 3 is connected to a valve rod 13 and is maintained in its closing position by valve springs 14 and 15 and a further pressure resisting spring 16, whereby the closing position is oriented against the fluid flow.

Figure 2:
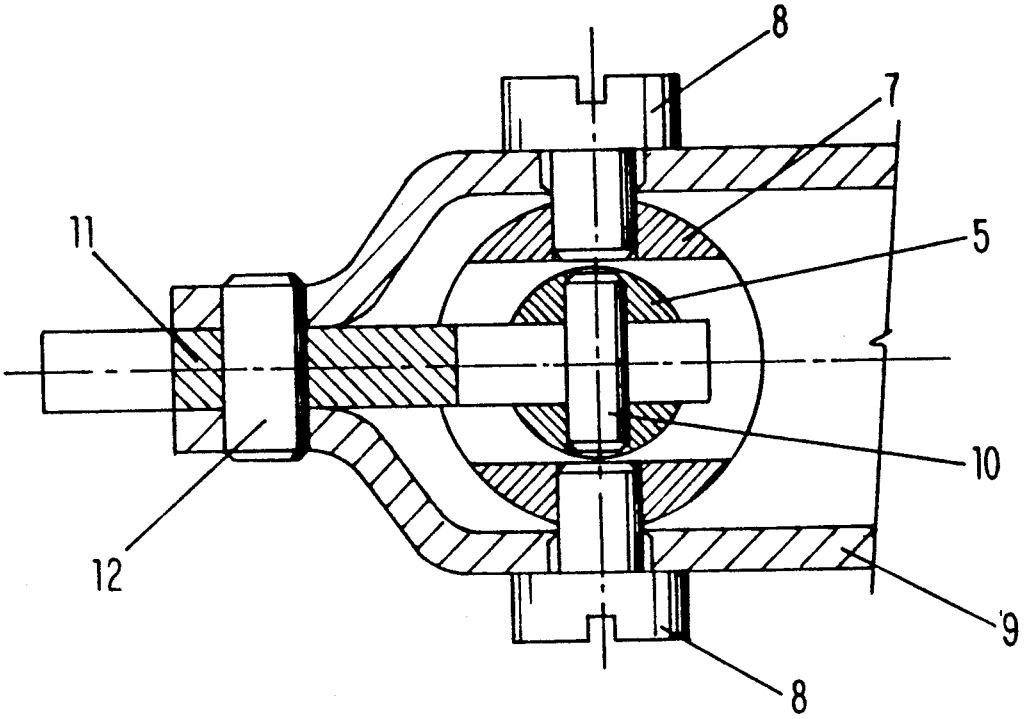
FIG. 2 is an enlarged representation of a view in the direction of the arrow A of FIG. 1, showing the connection of the manual lever with the control lever and the control element of the control means.

Between the inlet nozzle 1 and the flow valve 41 a control means 42 is disposed within the housing 40. The control means 42 comprises a plunger-type control element 5 in which a conical needle 4 is guided. In a cage-type cutout of the plunger-type control element 5 control balls are provided which are pressed against the inner walls of an arresting sleeve 7 via the conical needle 4 so that the plunger-type control element 5 is arrested relative to the arresting sleeve 7. The arresting sleeve 7 is provided with a formed end which penetrates the housing 40. A manual lever 9 disposed in the grip portion 49 is pivotably connected to the forked end of the arresting sleeve 7 via two bolts 8 (FIG. 2). At the end of the manual lever 9 that is pivotably connected to the arresting sleeve 7, a control level 11 is pivotably connected via a bolt 12 such that one end of the control lever 11 engages the valve rod 13 and the other end is supported between the legs of the forked end of the plunger-type control element 5 at a bolt 10 that is aligned with the bolts 8. The free end or head of the needle 4 is connected to a membrane 25 which delimits a vacuum chamber 43 in which a membrane spring 26 is disposed. The needle 4 is loaded by the membrane spring 26 in the direction of the plunger-type control element 5. The vacuum chamber 43 is connected via bores 24, 20 and 21 and the valve channel 18 in the valve seat 19 of the flow valve 41 to the pressure channel 22 in the outlet pipe 17. The pressure channel 22 has an opening 23 at the outlet pipe 17.

The outlet pipe 17 is surrounded by a bellows 29 which is connected with its upper end at the housing 40. The other end of the bellows is provided with an annular sealing element 28 in the area of the port 2 of the outlet pipe 17. The annular channel 44 between the outlet pipe 17 and the bellows 29 is connected via a gas recycling channel 45 within the housing 40 to the inlet nozzle 1. At the bellows 29 a push rod 31 is provided which engages a wedge-shaped slide bar 30 of a gas recycling safety means 46. The gas recycling safety means 46 comprises a ball valve 34 and a permanent magnet 32 which is spring loaded by a spring 33 in the direction of the ball valve 34. The ball valve 34 closes the connection between the bores 20 and 21 in the housing 40, whereby this connection is in the form of a jet 35. The closing is controlled by the permanent magnet 32 by changing the distance to the ball valve 34 against the force of the spring 33 via the slide bar 30. The permanent magnet 32 is fastened at a membrane 37 which is positioned in a recess of the housing 40. The slide bar 30 as well as the permanent magnet 32 are arranged within this recess. The recess is closed off by the membrane 37 and forms a pressure chamber 47. The pressure chamber 47 is connected via a bore 36 to the annular channel 44.

In the following paragraphs the function of the represented inventive hose nozzle will be explained in detail.

Figure 3A:
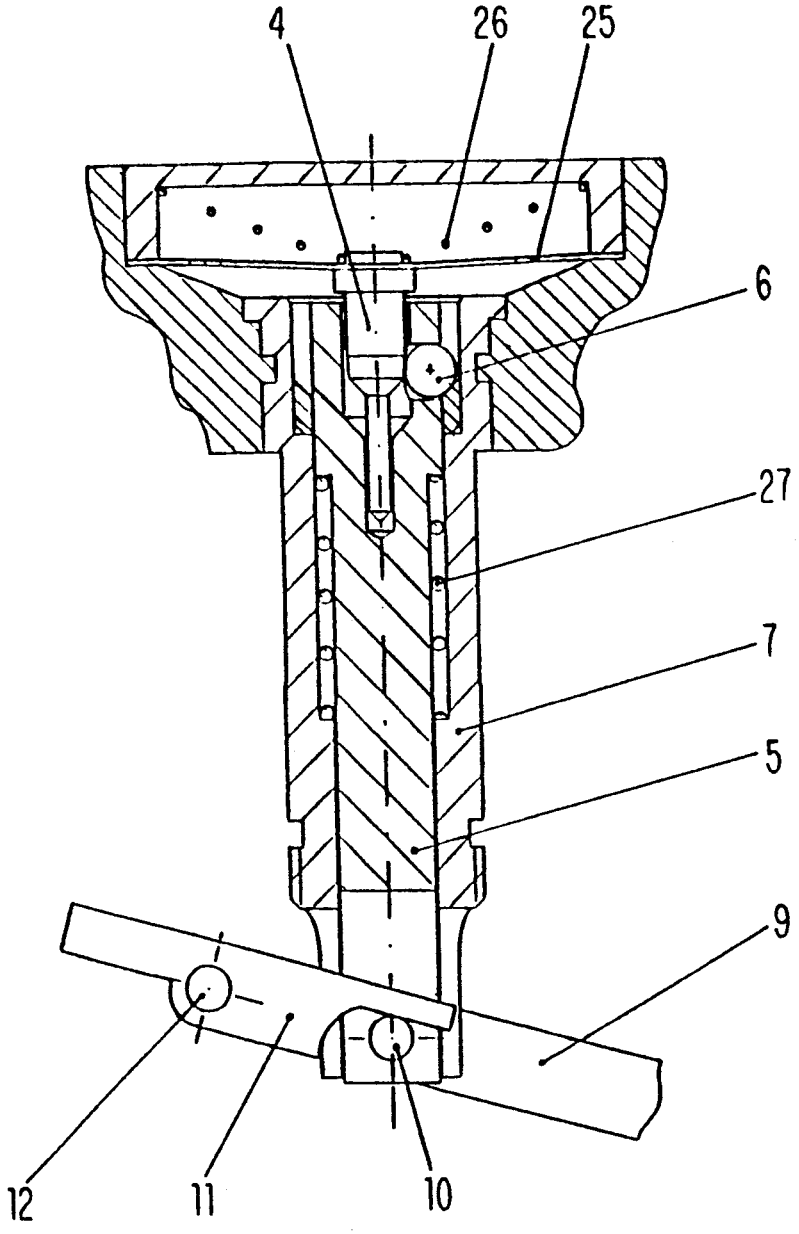
FIG. 3A shows an enlarged cross-sectional view of the control means of the hose nozzle according to FIG. 1 before the actuation of the manual lever for starting the filling process.
Figure 3B:
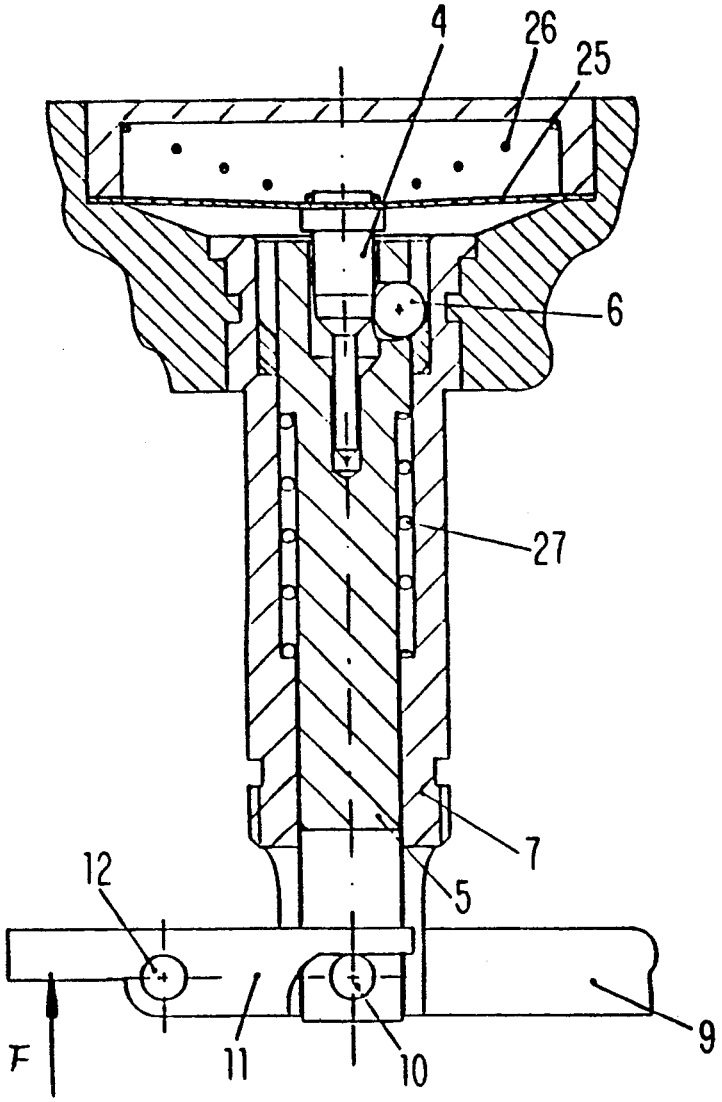
FIG. 3B is a cross-sectional view of the control means according to FIG. 3*a* during the filling process.

The fluid flowing from the inlet nozzle 1 via the fluid channel 39 to the port 2 is interrupted respectively controlled by the flow valve 41. An opening of this valve 41 is possible only when the control means 42 is engaged, whereby the needle 4 presses the control balls 6 against the inner wall of the arresting sleeve 7, thereby arresting the plunger-type control element 5 within the arresting sleeve 7 (FIGS. 3A and 3B). When the manual lever 9 is actuated the control lever 11, which is connected via the bolt 12 to the manual lever 9, is pivoted about the bolt 10 which forms the pivoting point and then may counter the force F (FIG. **3*b*) while the control means 42 is in its engaged position. The valve rod 13 is then moved against the force of the valve springs 14 and 15 away from the valve body 3. Due to the pressure of the fluid to be dispensed the valve body 3 opens against the force of the pressure resistant spring 16 so that fluid may be dispensed via the outlet pipe 17. The flow of the fluid generates a vacuum within the valve channel 18 of the valve seat 19 which is compensated by the ambiant via a line formed by the bores 20 and 21 as well as the pressure channel 22 and the opening 23**.

Figure 3C:
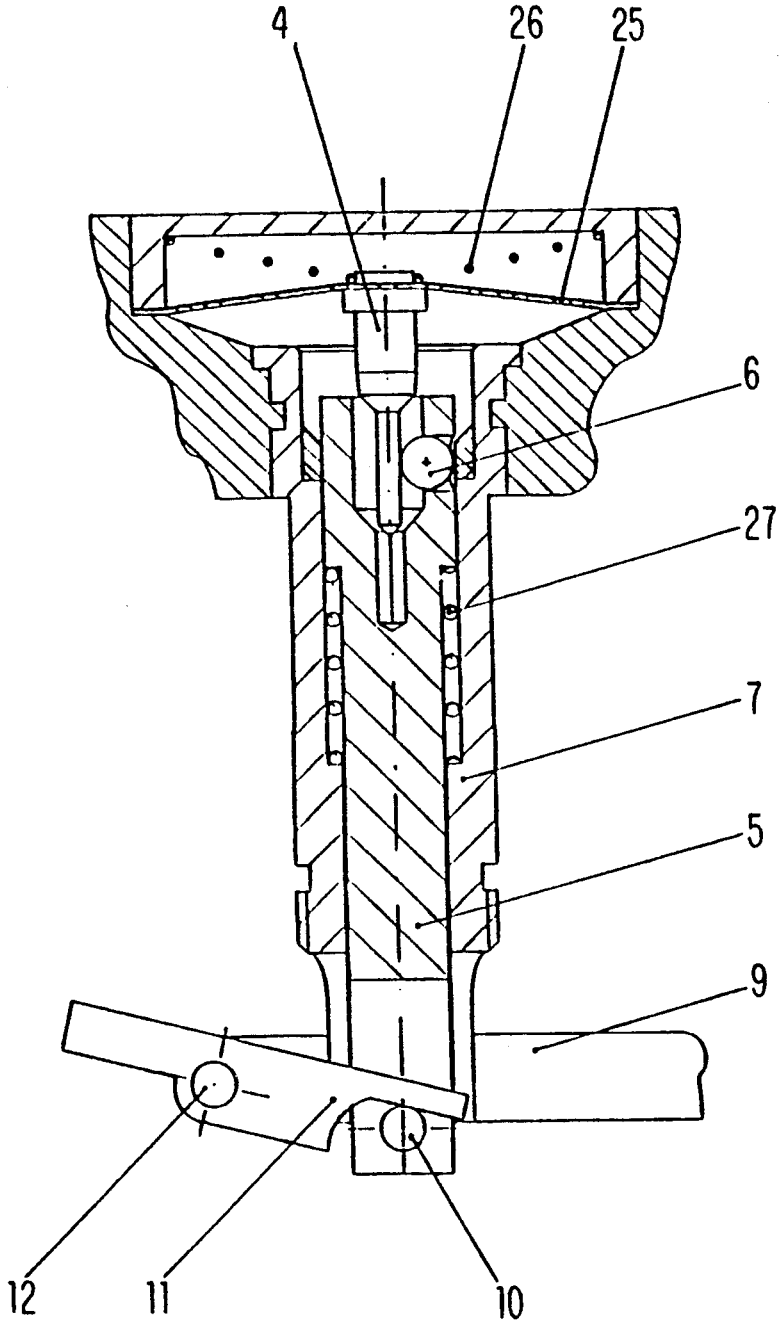
FIG. 3C is a cross-sectional view of the control means according to FIGS. 3*a* and 3*b* after the automatic shut-off of the filling process.

When the opening 23 is closed by fluid ascending in the filling nozzle of the container to be filled the vacuum may no longer be compensated via the pressure channel 22 and the bores 21 and 20 so that a vacuum will be generated which acts on the membrane 25 of the control means 42 via the bore 24 This vacuum lifts the membrane 25 and the needle 4 connected therewith against the force of the membrane spring 26 whereby the arresting connection between the plunger-type control element 5 and the arresting sleeve 7 is released. Then, the plunger-type control element 5 which is under a pull load generated by the control lever 11 at the bolts 10 is pulled out of the housing 40 respectively the arresting sleeve 7 (FIG. 3C). This means that the valve rod 13 is forced into its closing position by the valve springs 14 and 15. The control lever 11 is subsequently pivoted about the bolt 12 and the fluid dispension is automatically interrupted. The position of the manual lever 9 which is held at the arresting sleeve 7 is unchanged.

When after such an automatic shut-off the manual lever 9 is released it is then, together with the control lever 11 and the plunger-type control element 5, moved into its starting position (FIG. 3A) via the return spring 27. Simultaneously, the needle 4 and the membrane 25 are restored into their starting position by the membrane spring 26 so that via the control balls 6 the control means 42, respectively the control element 5 within the arresting sleeve 7, is again arrested. Upon actuation of the manual lever 9 fluid may again be dispensed via the hose nozzle.

The essential requirement for the fluid dispension, however, is the proper introduction of the outlet pipe 17 into the filling nozzle of the container to be filled (not represented), thus achieving a gas-tight connection between the filling nozzle and the bellows 29 with its sealing element 28.

When the outlet pipe 17 is introduced into the filling nozzle the sealing element 28 contacts the opening of the filling nozzle so that the bellows 29 is compressed and the wedge-shaped slide bar 30 is displaced by the push rod 31 such that the permanent magnet 32 is moved in the direction of the ball valve 34 via the spring 33. Due to the resulting reduction of the distance between the permanent magnet 32 and the ball valve 34, the ball valve 34 is lifted by the magnetic force of the permanent magnet 32 thus opening the connection between the bores 20 and 21, respectively the jet 35. Only now is it possible to dispense fluid with the hose nozzle because a vacuum within the vacuum chamber 43 of the control means 42 may not be generated in the manner described above.

When the hose nozzle is removed from the filling nozzle of the tank the bellows 29 relaxes so that the wedge-shaped slide bar 30 lifts the permanent magnet 32 against the force of the spring 33 whereby, due to the reduced magnetic force the ball valve 34 returns into its starting position and the jet 35 is closed. The dispension of fluid is now impossible since, due to the interrupted connection between the valve channel 18 and the atmosphere, a vacuum within the vacuum chamber 43 of the control means 42 is generated via the pressure channel 22.

If a pressure is generated during the fluid dispension within the gas recycling system that exceeds, for example, 250 mm water column pressure, this pressure will act via the bore 36 onto the membrane 37 and will lift the membrane together with the permanent magnet 32 so that the ball valve 34 will fall back into its starting position due to the reduced magnetic forces thereby closing the jet 35 and interrupting the fluid dispension.

Figure 4A:
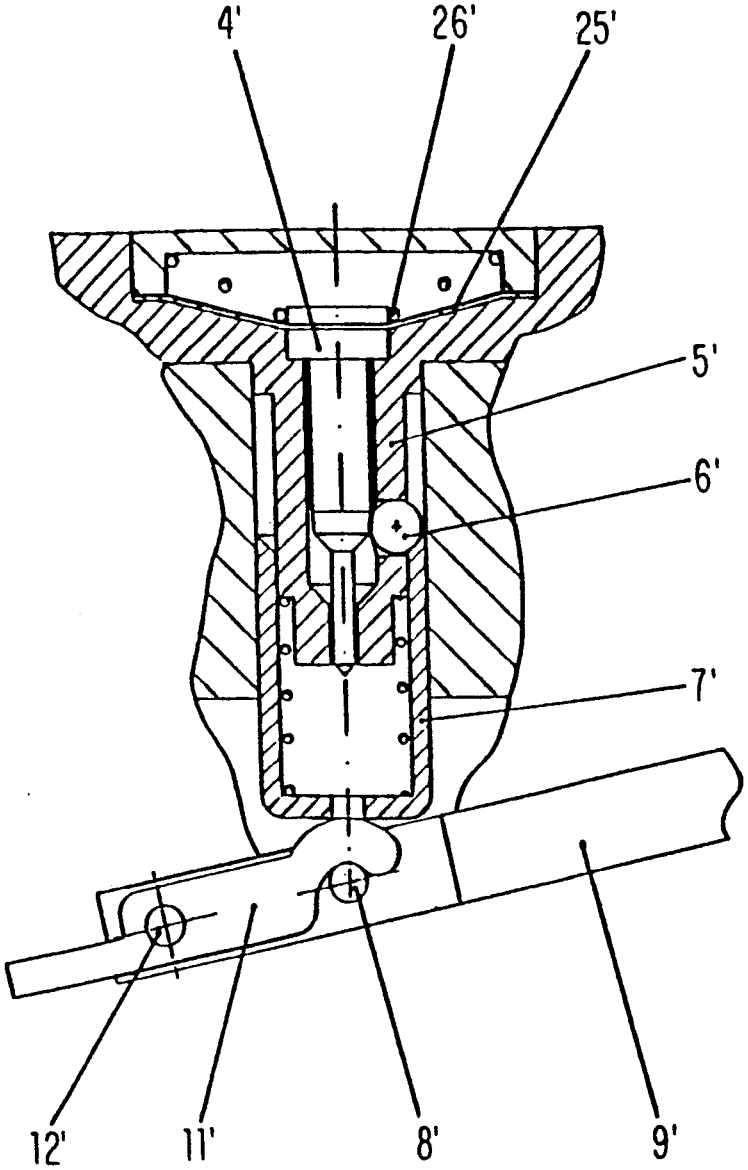
FIG. 4A is a cross-sectional view of a further embodiment of the control means of the hose nozzle before the actuation of the manual lever for starting the filling process.
Figure 4B:
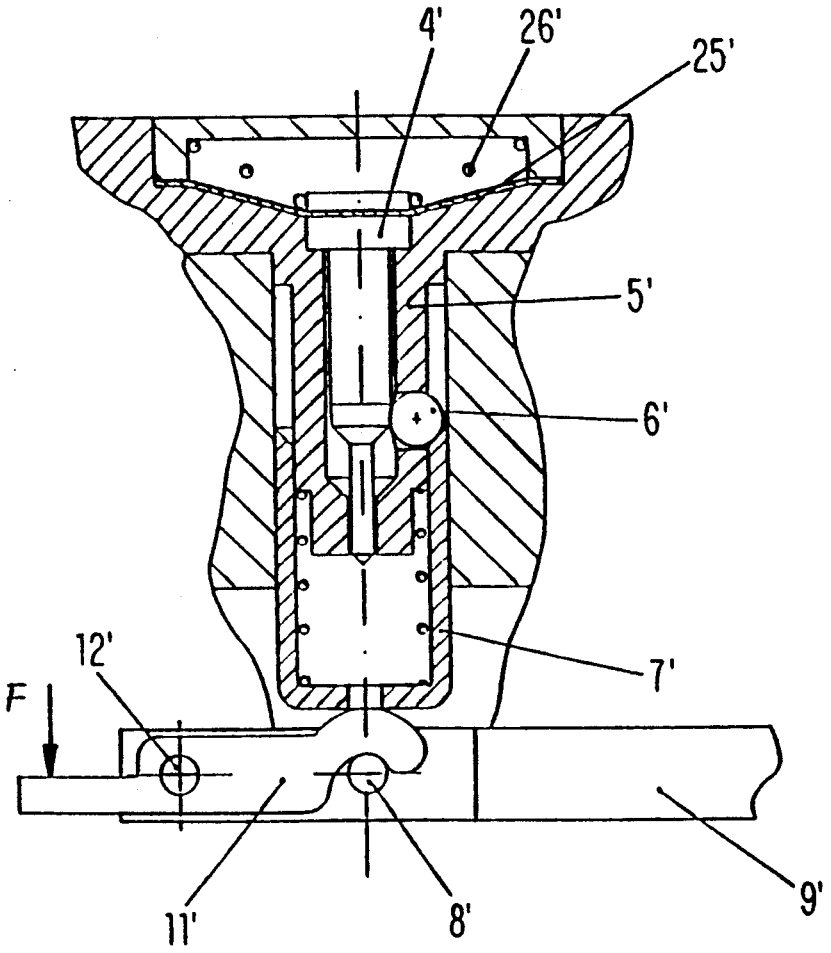
FIG. 4B is a cross-sectional view of the control means according to FIG. 4*a* during the filling process.
Figure 4C:
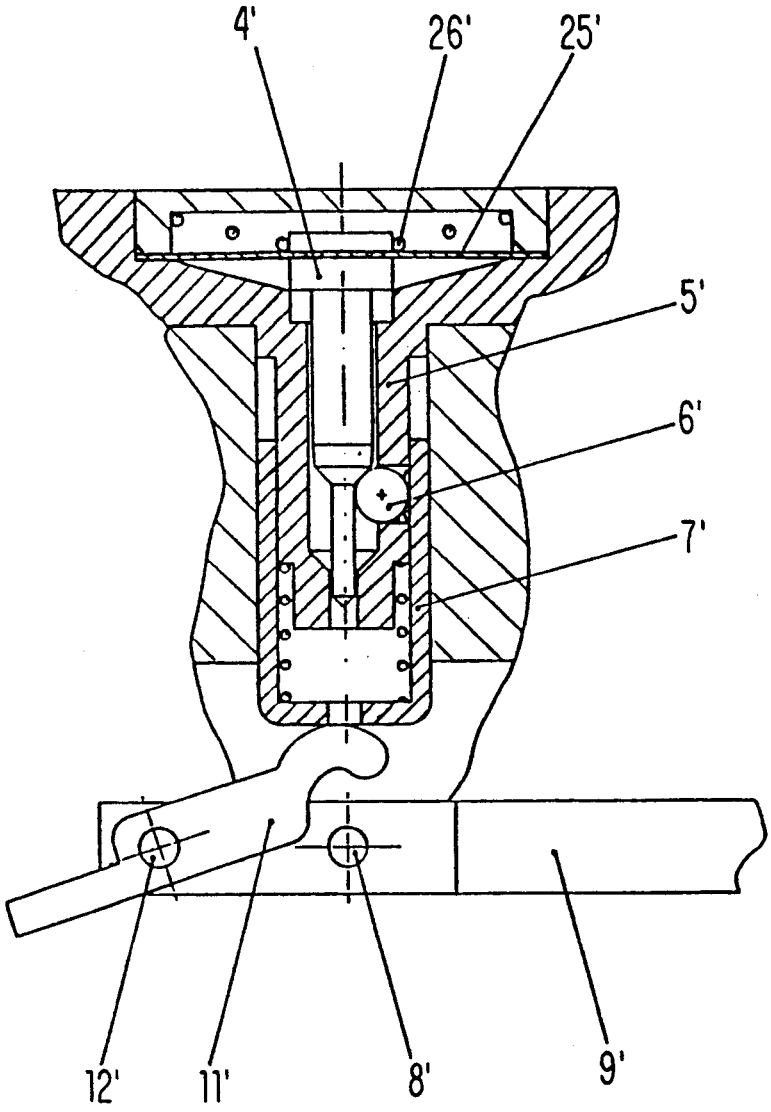
FIG. 4C is a cross-sectional view of the control means according to FIGS. 4*a* and 4*b* after automatic shut-off of the filling process.
Figure 5:
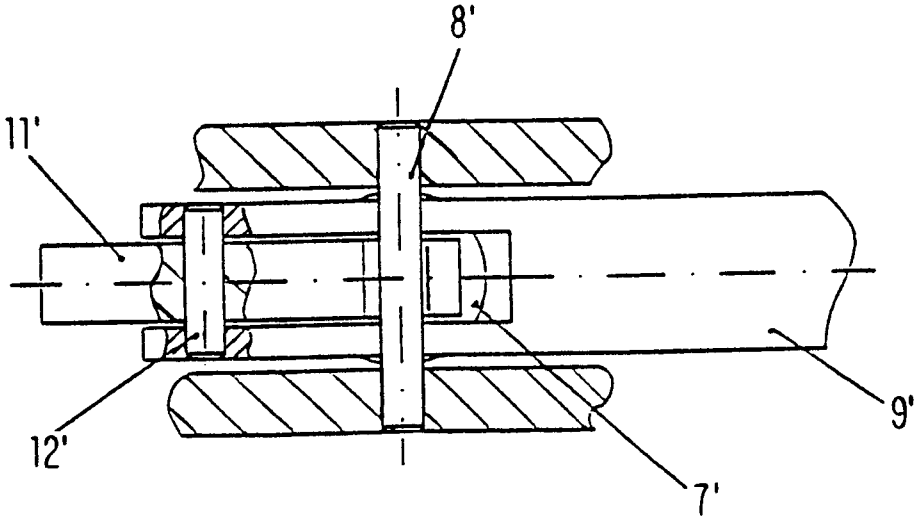
FIG. 5 is a view in the direction of arrow B of FIG. 4*b*, showing the connection of the manual lever to the control lever and the resting sleeve of the control means.

The control means represented in FIGS. 4A, 4B and 4C essentially differs from the control means 42 represented in FIGS. 3A, 3B and 3C by having the manual lever 9′ connected to the housing fork 48 and not to the arresting sleeve 7′, and by having the arresting sleeve 7′ slidable relative to the fixedly positioned plunger-type control element 5′. The opening of the flow valve with this control means is possible only when the conical needle 4′ is introduced into the plunger-type control element 5′ (FIGS. 4A and 4B) and the control balls 6′ are thereby forced into a position in which the arresting sleeve 7′ is arrested with the control element 5′ against the upwardly directed pressure. The manual lever 9′ is fastened by a bolt 8′ which represents the pivoting point for the manual lever 9′.

When the manual lever 9′ is actuated the control lever 11′ which is connected via the bolt 12′ to the manual lever 9′, is pivoted about the bolt 8′ and may act against the force F when the control means is in its engaged position When at this point in time the hose nozzle is shut off, the membrane 25′ and the needle 4′ are lifted so that the control balls 6′ are no longer held in position (FIG. 4C). The arresting sleeve 7′ may then move in an upward direction so that the control lever 11′ is no longer in a fixed position at the pivoting point of the bolt 8′ and is pivoted about the bolt 12′ by the force F.

The present invention is, of course, in no way restricted to the specific disclosure of the specification and drawings, but also encompasses any modifications within the scope of the appended claims.

What I claim is:

1. A hose nozzle for filling fluid into a tank and for shutting off automatically when the tank is filled, comprising:

a nozzle housing having an inlet nozzle and an outlet pipe at opposite ends of said nozzle housing and a grip portion in an area of said inlet nozzle;

a flow valve disposed in said nozzle housing and connected between said inlet nozzle and said outlet pipe for controlling a fluid flow therethrough, said flow valve further comprising a valve rod extending into said grip portion;

a control means, comprising a pressure generating means for generating pressure as a function of said fluid flow, a pressure channel in said outlet pipe communicating with said pressure generating means, a control element housing having a plunger-type control element extending from said control element housing into said grip portion, said plunger-type control element including means responsive to said pressure generated by said pressure generating means, whereby the pressure generated by said pressure generating means is divided between said pressure channel and said plunger-type control element at a first pressure level, said plunger-type control element being retained in an extended position and movable to a retracted position when a second pressure level greater than said first pressure level is sensed by said plunger-type control element said control means is disposed in said nozzle housing between said inlet nozzle and said flow valve and said pressure channel is connected to a port in said outlet pipe;

a manual lever, disposed within said grip portion and pivotably connected at an intermediate portion thereof to said control element housing; and a control lever pivotably connected at an intermediate portion thereof to one end of said manual lever and pivotably supported at one end thereof to said valve rod; whereby said manual lever and control lever are pivoted about said pivotal connection to said plunger-type control element to actuate said flow valve causing a fluid flow generating said pressure, and wherein when said tank is filled such that said port is obstructed by said fluid, said second pressure level is sensed by said plunger-type control element to thereby move said plunger-type control element to said retracted position and cause said flow valve to close.

2. A hose nozzle according to claim 1, further comprising:

a bellows surrounding said outlet pipe and connected with one end to said nozzle housing in a gas-tight manner and with the other end arranged adjacent to said port of said outlet pipe;

a sealing element connected to said other end of said bellows adapted to engage a filling nozzle of a tank to be filled;

an annular channel disposed between said outlet pipe and said bellows;

a gas recycling channel that is connected to said inlet nozzle and said annular channel;

a connecting channel connecting said plunger-type control element and said pressure channel; and a safety means for closing said connecting channel

3. A hose nozzle according to claim 2, wherein said safety means further comprises:

a slide bar that is operatively connected to said bellows;

a membrane disposed in a recess of said nozzle housing;

a permanent magnet connected to said membrane, with a position of said permanent magnet being changed by displacement of said slide bar; and a ball valve, that is positioned in said connecting channel and is actuated by said permanent magnet, for closing said connecting channel.

4. A hose nozzle according to claim 3, further comprising a push rod that is connected to said bellows and engages said slide bar.

5. A hose nozzle according to claim 3, wherein said membrane together with said recess delimits a pressure chamber that communicates with said annular channel.

* * * * *

UNITED STATES PATENT AND TRADEMARK OFFICE

CERTIFICATE OF CORRECTION

PATENT NO. : 5,224,525

DATED : July 6, 1993

INVENTOR(S) : Weichel

It is certified that error appears in the above-identified patent and that said Letters Patent is hereby corrected as shown below:

On the title page: Assignee should read;

[73] Assignee: Oscar Gossler KG (GmbH & Co.),
Reinbek, Germany

Signed and Sealed this

Twenty-ninth Day of March, 1994

*Attest:*

Bruce Lehman

BRUCE LEHMAN

*Attesting Officer*

*Commissioner of Patents and Trademarks*